US009521917B2

(12) United States Patent
Rai

(10) Patent No.: US 9,521,917 B2
(45) Date of Patent: Dec. 20, 2016

(54) BEDDING SYSTEM

(71) Applicant: Gagan Rai, Haryana (IN)

(72) Inventor: Gagan Rai, Haryana (IN)

( * ) Notice: Subject to any disclaimer, the term of this patent is extended or adjusted under 35 U.S.C. 154(b) by 0 days.

(21) Appl. No.: 14/564,553

(22) Filed: Dec. 9, 2014

(65) Prior Publication Data

US 2016/0157640 A1 Jun. 9, 2016

(51) Int. Cl.
*A47G 9/02* (2006.01)
*A47G 9/00* (2006.01)

(52) U.S. Cl.
CPC ..... *A47G 9/0238* (2013.01); *A47G 9/0246* (2013.01); *A47G 9/0253* (2013.01)

(58) Field of Classification Search
CPC ..... A47G 9/00; A47G 9/02; A47G 9/0207; A47G 9/0223; A47G 9/0238; A47G 9/0246; A47G 9/0253
USPC ..... 5/490, 495, 497, 482
See application file for complete search history.

(56) References Cited

U.S. PATENT DOCUMENTS 3,044,517 A * 7/1962 Levi ..... 150/158
3,109,474 A * 11/1963 Levi ..... 150/158
5,118,553 A * 6/1992 Boisson ..... 428/99
5,240,758 A * 8/1993 Honigberg ..... 428/100
5,664,269 A * 9/1997 Broder ..... 5/486
5,836,023 A * 11/1998 Stone Munson ..... 5/482
5,940,909 A * 8/1999 Sapp ..... 5/490
7,624,460 B2 * 12/2009 Maimone et al. ..... 5/501
8,011,038 B2 * 9/2011 Balasundharam ..... 5/496
2007/0028383 A1 * 2/2007 Mehrotra ..... 5/482
2009/0126111 A1 * 5/2009 Maimone et al. ..... 5/485
2010/0306920 A1 * 12/2010 Balasundharam ..... 5/496
2012/0186016 A1 * 7/2012 Martin ..... 5/490
2014/0338130 A1 * 11/2014 Russell ..... 5/636
2015/0007388 A1 * 1/2015 Harrison ..... 5/490

* cited by examiner

*Primary Examiner* — Robert G Santos

(57) ABSTRACT

A piece of fabric has a first side with a first visual characteristic and a second side with a second visual characteristic. A fold is formed in the piece of fabric to create a bedding component with a primary face having a folded-over minor section and a non-folded-over major section. The major section has the first visual characteristic. The minor section has the second visual characteristic. The bedding component has a secondary face having the second visual characteristic. Stitching holds the piece of fabric with the folded-over minor section being essentially coplanar with the non-folded-over major section thereby exposing the primary face when in a primary orientation and the secondary face when in a secondary orientation.

8 Claims, 4 Drawing Sheets

FIG. 2
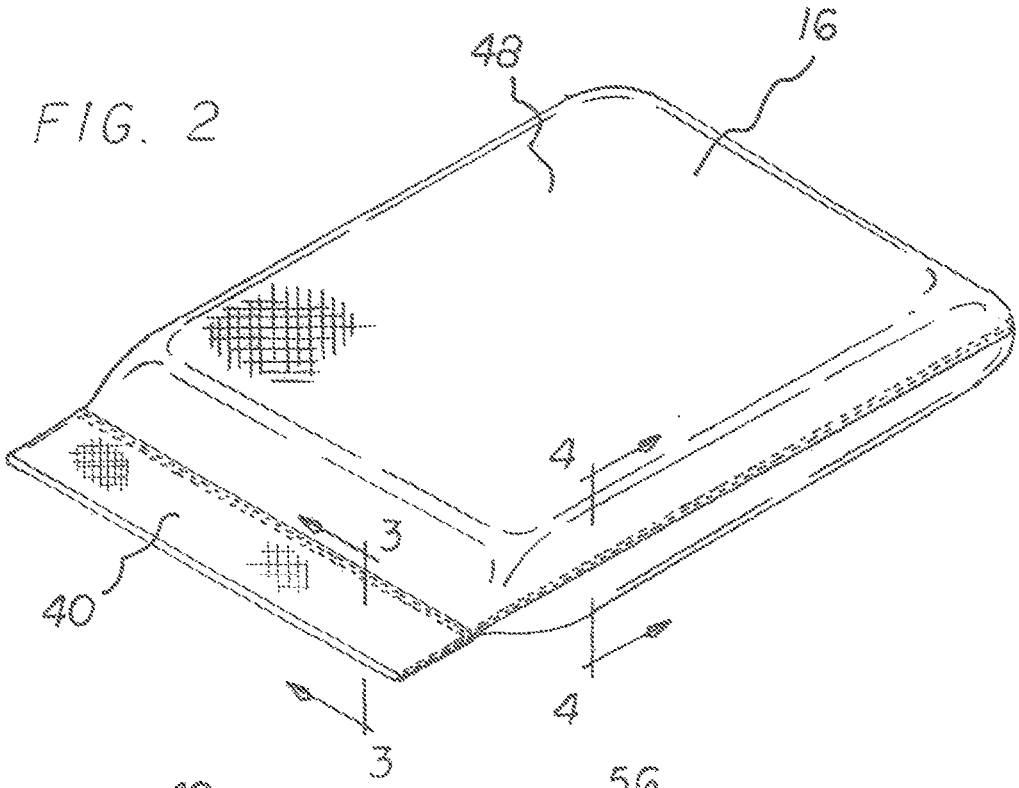
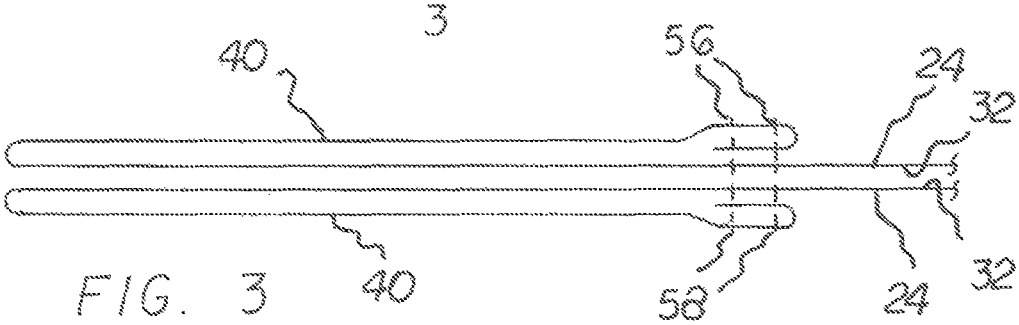
FIG. 3
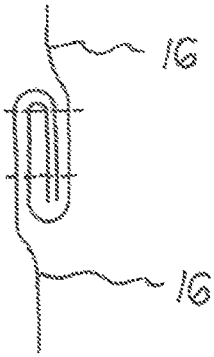
FIG. 4

BEDDING SYSTEM

BACKGROUND OF THE INVENTION

Field of the Invention

The present invention relates to a bedding system and more particularly pertains to covering a bed in a first visual characteristic and covering the bed in a second visual characteristic different from the first visual characteristic in an eye-appealing, convenient, and economic manner.

Description of the Prior Art

The use of bedding of known designs and configurations is known in the prior art. More specifically, bedding of known designs and configurations previously devised and utilized for the purpose of covering beds are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a bedding system that allows covering a bed in a first visual characteristic and covering the bed in a second visual characteristic different from the first visual characteristic in an eye-appealing, convenient, and economic manner.

In this respect, the bedding system according to the present invention substantially departs from the conventional concepts and designs of the prior art, and in doing so provides an apparatus primarily developed for the purpose of xfxnew.

Therefore, it can be appreciated that there exists a continuing need for a new and improved bedding system which can be used for covering a bed in a first visual characteristic and for covering the bed in a second visual characteristic different from the first visual characteristic in an eye-appealing, convenient, and economic manner. In this regard, the present invention substantially fulfills this need.

SUMMARY OF THE INVENTION

In view of the foregoing disadvantages inherent in the known types of bedding of known designs and configurations now present in the prior art, the present invention provides an improved bedding system. As such, the general purpose of the present invention, which will be described subsequently in greater detail, is to provide a new and improved bedding system and method which has all the advantages of the prior art and none of the disadvantages.

To attain this, from a broad perspective, the present invention essentially comprises a piece of fabric having a first side with a first visual characteristic and a second side with a second visual characteristic. A fold is formed in the piece of fabric to create a bedding component with a primary face having a folded-over minor section and a non-folded-over major section. The major section has the first visual characteristic. The minor section has the second visual characteristic. The bedding component has a secondary face having the second visual characteristic. Stitching holds the piece of fabric with the folded-over minor section being essentially coplanar with the non-folded-over major section thereby exposing the primary face when in a primary orientation and the secondary face when in a secondary orientation.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bedding system which has all of the advantages of the prior art bedding of known designs and configurations and none of the disadvantages.

It is another object of the present invention to provide a new and improved bedding system which may be easily and efficiently manufactured and marketed.

It is a further object of the present invention to provide a new and improved bedding system which is of durable and reliable constructions.

An even further object of the present invention is to provide a new and improved bedding system which is susceptible of a low cost of manufacture with regard to both materials and labor, and which accordingly is then susceptible of low prices of sale to the consuming public, thereby making such bedding system economically available to the buying public.

Lastly, another object of the present invention is to provide a bedding system for covering a bed in a first visual characteristic and for covering the bed in a second visual characteristic different from the first visual characteristic, in an eye-appealing, convenient, and economic manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a plan view of the pillowcase of the bedding system shown in FIG. 1.

FIG. 3 is a cross sectional view taken alone line 3-3 of FIG. 2.

FIG. 4 is a cross sectional view taken along line 4-4 of FIG. 2.

The same reference numerals refer to the same parts throughout the various Figures.

DESCRIPTION OF THE PREFERRED EMBODIMENT

Figure 1:
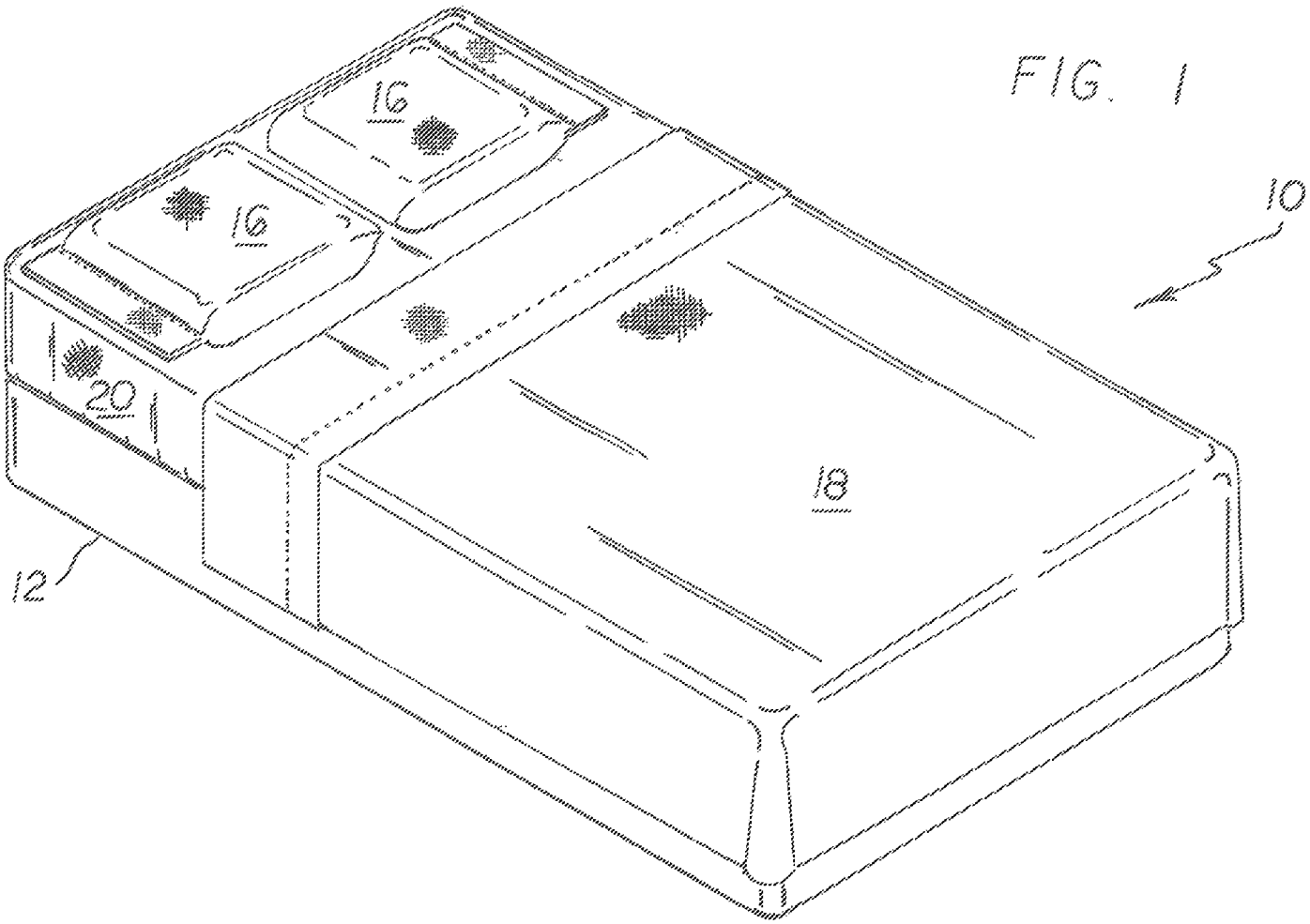
FIG. 1 is a perspective illustration of a bedding system constructed in accordance with the principles of the resent invention.
Figure 5:
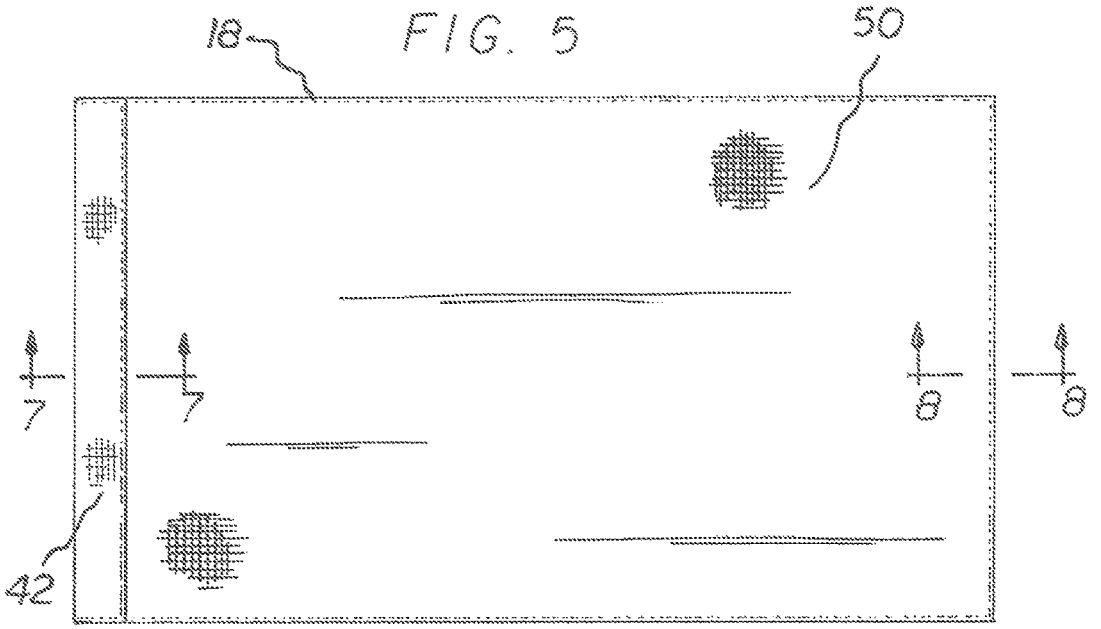
FIG. 5 is a plan view of the top sheet of the bedding system shown in FIG. 1.
Figure 6:
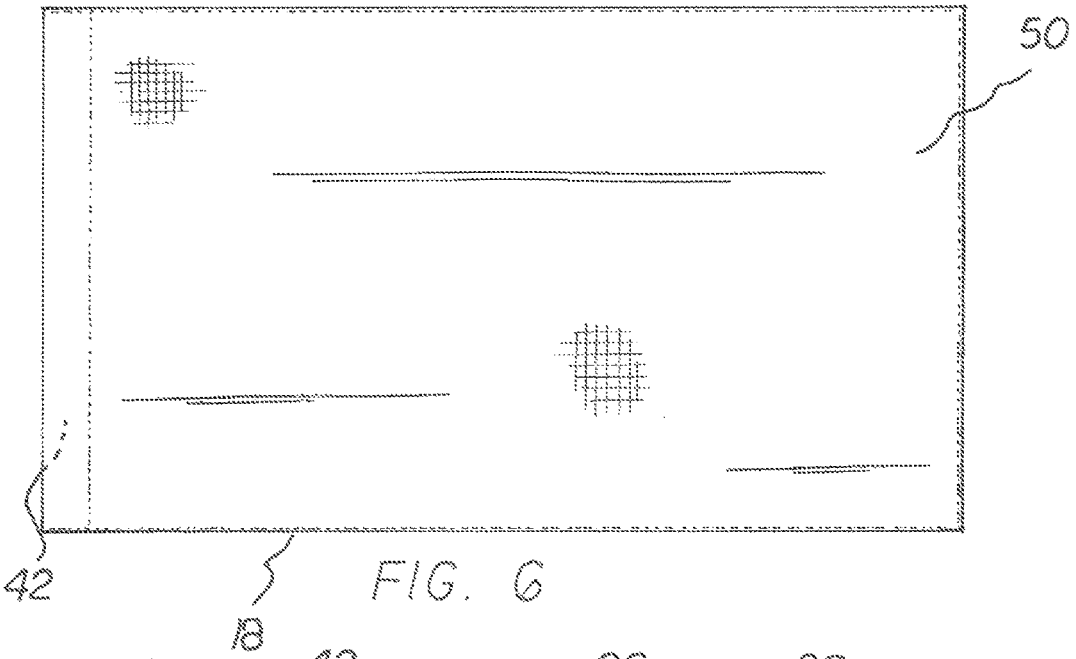
FIG. 6 is a bottom view of the top sheet of the bedding system shown in FIG. 1.
Figure 7:
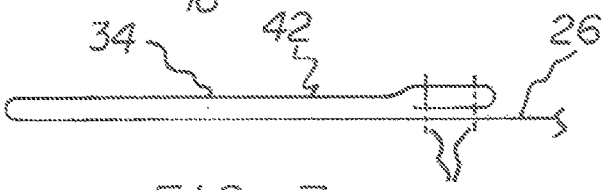
FIG. 7 is a cross sectional view taken along line 7-7 of FIG. 5.
Figure 8:
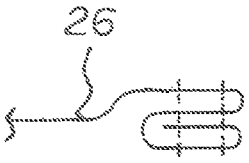
FIG. 8 is a cross sectional view taken along line 8-8 of FIG. 5.
Figure 9:
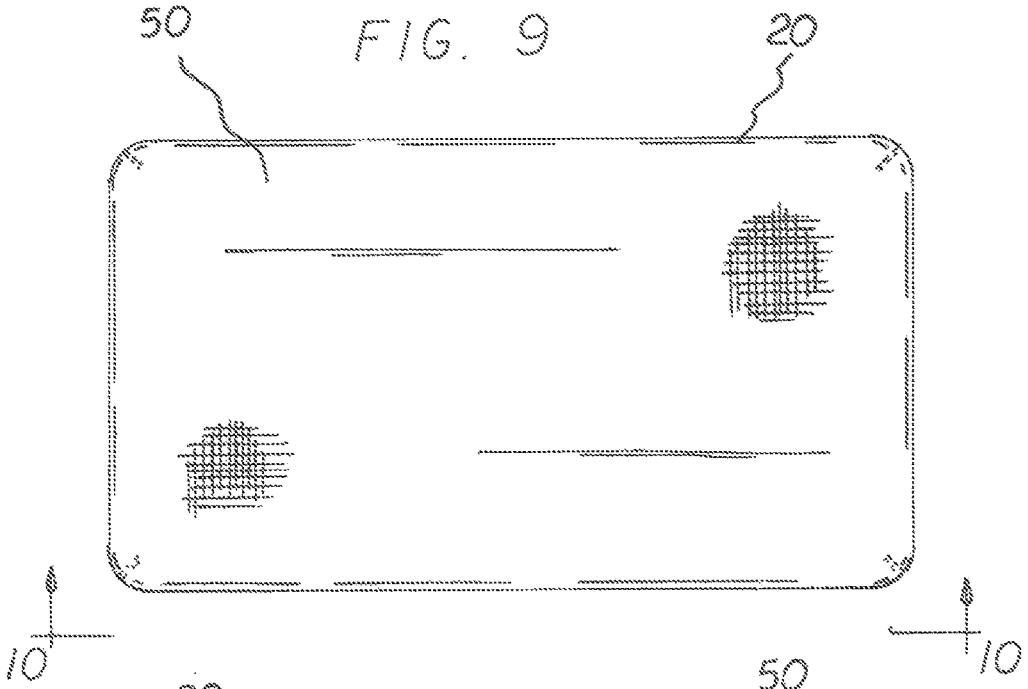
FIG. 9 is a plan view of the fitted sheet of the bedding system shown in FIG. 1.
Figure 10:
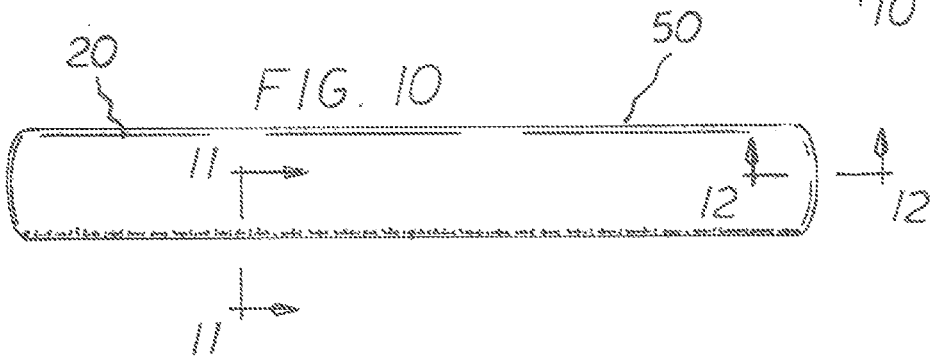
FIG. 10 is a cross sectional view taken along line 10-10 of FIG. 9.
Figure 11:
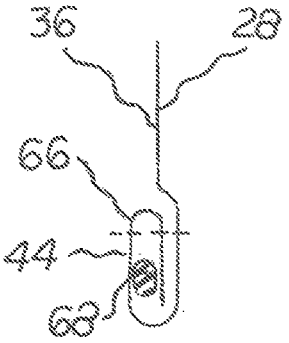
FIG. 11 is a cross sectional view taken along line 11-11 of FIG. 9.
Figure 12:
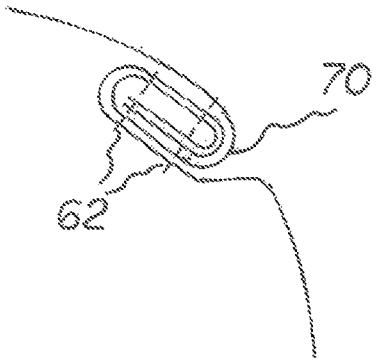
FIG. 12 is a cross sectional view taken along line 12-12 of FIG. 9.

With reference now to the drawings, and in particular to FIG. 1 thereof, the preferred embodiment of the new and improved bedding system embodying the principles and concepts of the present invention and generally designated by the reference numeral 10 will be described.

The present invention, the bedding system 10 is comprised of a plurality of components. Such components in their broadest context include a piece of fabric, a fold, and stitching. Such components are individually configured and correlated with respect to each other so as to attain the desired objective.

From a specific standing, the invention is a bedding system 10 for covering a bed 12 in a first visual characteristic, and for covering the bed in a second visual characteristic different from the first visual characteristic. The covering is done in an eye-appealing, convenient, and economic manner.

In the preferred embodiment, a first piece of fabric 16, a second piece of fabric 18, and a third piece of fabric 20 are provided. Each piece of fabric has a first side 24, 26, 28 of a first color. Each piece of fabric has a second side 32, 34, 36 with a second color different from the first color. Other visual characteristics could include different patterns, a plain side and a patterned side, etc.

Next at least one 180 degree fold is formed in each piece of fabric to create a bedding component. The bedding component has a primary face with a folded-over minor section 40, 42, 44 and a non-folded-over major section 48, 50, 52. The major section has the first color. The minor section has the second color. The bedding component has a secondary face. The secondary face has only the second color.

Stitching 56, 58, 60, 62 is next provided. The stitching holds the piece of fabric with the folded-over minor section being essentially coplanar with the non-folded-over major section. In this manner, the primary face is exposed when in a primary orientation and the secondary face is exposed when in a secondary orientation.

The first piece of fabric is a pillowcase with an upper piece of fabric and a lower piece of fabric. A chamber is formed between the upper piece of fabric and the lower piece of fabric. The chamber has an open end for the passage of a pillow into and out of the chamber. The chamber has a folded closed end. The folded-over minor section is located entirely around the open end. Converting between the primary and secondary orientations is done through the turning of the pillowcase inside out. The pillowcase has a length of 40 inches plus or minus 20 percent and a width of 22 inches plus or minus 20 percent. The minor section has a length of 4 inches plus or minus 20 percent. The length of the pillow is between 8 and 12 times the length of the minor section.

The second piece of fabric is a top sheet fabricated of a single piece of fabric. Converting between the primary and secondary orientations is through the turning of the top sheet upside down. The top sheet has a length of 50 inches plus or minus 20 percent and a width of 54 inches plus or minus 20 percent. The minor section has a length of 4 inches plus or minus 20 percent. The length of the top sheet is between 10.5 and 14.5 times the length of the minor section.

The third piece of fabric is a fitted sheet fabricated of a single piece of fabric. Converting between the primary and secondary orientations is through the turning of the fitted sheet inside out. The fitted sheet has a periphery formed with a hem 66 and an elastic band 68 in the hem. The fitted sheet has corner gussets 70 with the minor section located in the corner gussets. The fitted sheet has a length of 80 inches plus or minus 20 percent and a width of 76 inches plus or minus 20 percent. The minor section has a length of 0.5 inches plus or minus 20 percent. The length of the fitted sheet is in excess of 100 times the length of the minor section.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bedding system comprising:

a single piece of fabric having a first end and a second end and a first edge and a second edge, the single piece of fabric having a first side with a first visual characteristic, the single piece of fabric having a second side with a second visual characteristic;

two folds formed in the single piece of fabric to create a pillowcase with two primary faces, each primary face having a folded-over minor section and a non-folded-over major section, each major section having the first visual characteristic, the minor section having the second visual characteristic, the bedding component having secondary faces, each secondary face having the second visual characteristic; and stitching holding the piece of fabric with the folded-over minor sections being essentially coplanar with the non-folded-over major sections, thereby exposing the primary face when in a primary orientation, and thereby exposing the secondary face when turned inside out to a secondary orientation;

wherein the pillowcase is fabricated of a single piece of fabric with an upper section of fabric and a similarly configured lower section of fabric, a single chamber between the upper section of fabric and the lower section of fabric, the single chamber having an open end for the passage of a pillow into and out of the chamber, the chamber having a folded closed end, the folded-over minor section located entirely around the open end, whereby the turning of the pillowcase inside out will convert the pillowcase to the secondary orientation from the primary orientation.

2. The system as set forth in claim 1 wherein the pillowcase has a length of 40 inches plus or minus 20 percent and a width of 22 inches plus or minus 20 percent and the minor section has a length of 4 inches plus or minus 20 percent, the length of the pillow being between 8 and 12 times the length of the minor section.

3. The system as set forth in claim 1 wherein the bedding system includes a top sheet fabricated of a single piece of fabric, whereby the turning of the top sheet upside down will convert the top sheet to the secondary orientation from the primary orientation.

4. The system as set forth in claim 3 wherein the top sheet has a length of 50 inches plus or minus 20 percent and a width of 54 inches plus or minus 20 percent and the minor section has a length of 4 inches plus or minus 20 percent, the length of the top sheet being between 10.5 and 14.5 times the length of the minor section.

5. The system as set forth in claim 1 wherein the bedding system includes a fitted sheet fabricated of a single piece of fabric, whereby the turning of the fitted sheet inside out will convert the fitted sheet to the secondary orientation from the primary orientation.

6. The system as set forth in claim 5 wherein the fitted sheet has a length of 80 inches plus or minus 20 percent and a width of 76 inches plus or minus 20 percent and the minor section has a length of 0.5 inches plus or minus 20 percent, the length of the fitted sheet being in excess of 100 times the length of the minor section.

7. The system as set forth in claim 1 wherein the first visual characteristic is a first color and the second characteristic is a second color.

8. The system as set forth in claim 5 and further including:

a top sheet fabricated of a single piece of fabric, whereby the turning of the top sheet upside down will convert the top sheet to the secondary orientation from the primary orientation.

* * * * *